US009574817B2

(12) United States Patent
Cloyd

(10) Patent No.: US 9,574,817 B2
(45) Date of Patent: Feb. 21, 2017

(54) MEDICAL PRODUCTS STORAGE DEVICE WITH VIEWING WINDOW HAVING VARIABLE OPACITY

(71) Applicant: Helmer, Inc., Noblesville, IN (US)

(72) Inventor: Stephen T. Cloyd, Greenfield, IN (US)

(73) Assignee: Helmer, Inc., Noblesville, IN (US)

( * ) Notice: Subject to any disclaimer, the term of this patent is extended or adjusted under 35 U.S.C. 154(b) by 0 days.

(21) Appl. No.: 14/202,648

(22) Filed: Mar. 10, 2014

(65) Prior Publication Data

US 2014/0265759 A1 Sep. 18, 2014

Related U.S. Application Data

(60) Provisional application No. 61/786,798, filed on Mar. 15, 2013.

(51) Int. Cl.

| | |
|---|---|
| ***G08B 21/00*** | (2006.01) |
| ***F25D 23/02*** | (2006.01) |
| ***A47B 67/02*** | (2006.01) |
| *G08B 13/14* | (2006.01) |
| *H04Q 5/22* | (2006.01) |
| *A47F 3/04* | (2006.01) |
| *A47B 96/04* | (2006.01) |
| *H04N 5/64* | (2006.01) |
| *G06F 17/00* | (2006.01) |
| *E06B 7/00* | (2006.01) |
| *F25D 27/00* | (2006.01) |
| *F25D 29/00* | (2006.01) |

(52) U.S. Cl.

CPC ..... *F25D 23/02* (2013.01); *A47B 67/02* (2013.01); *F25D 27/00* (2013.01); *F25D 29/008* (2013.01)

(58) Field of Classification Search

CPC ..... F25D 23/02; F25D 27/00; F25D 29/008; A47B 67/02

USPC ..... 340/540; 312/209; 348/836; 428/432

See application file for complete search history.

(56) References Cited

U.S. PATENT DOCUMENTS

| | | | | |
|---|---|---|---|---|
| 9,078,520 | B2 * | 7/2015 | Shoenfeld | A47B 81/00 |
| 2006/0097868 | A1 * | 5/2006 | Ingram | G07F 9/02 340/571 |
| 2007/0113377 | A1 * | 5/2007 | Brachert | E05D 7/04 16/247 |
| 2008/0122615 | A1 * | 5/2008 | Shoenfeld | G08B 13/2402 340/540 |
| 2009/0076650 | A1 * | 3/2009 | Faes | G07F 11/165 700/232 |
| 2009/0197097 | A1 * | 8/2009 | Medwick | B32B 17/06 428/432 |
| 2011/0239676 | A1 * | 10/2011 | Saunders | A47F 3/0404 62/251 |
| 2012/0285089 | A1 * | 11/2012 | Artwohl | A47F 3/0434 49/70 |
| 2012/0286638 | A1 * | 11/2012 | Lee | F25D 23/02 312/405 |
| 2013/0119847 | A1 * | 5/2013 | Seo | F25D 23/028 312/405 |

(Continued)

*Primary Examiner* — Jack K Wang

(74) *Attorney, Agent, or Firm* — Barnes & Thornburg LLP

(57) ABSTRACT

A medical products storage device, such as a refrigerator, includes a door having a viewing window. The window has a variable opacity so that the viewing window may be transparent or opaque, depending on conditions of the medical products storage device. Light emitting diodes embedded in the viewing window are used to indicate an alarm condition.

19 Claims, 4 Drawing Sheets

(56) References Cited

U.S. PATENT DOCUMENTS

2014/0078407 A1* 3/2014 Green ..... G09F 9/35
348/836

* cited by examiner

MEDICAL PRODUCTS STORAGE DEVICE WITH VIEWING WINDOW HAVING VARIABLE OPACITY

CROSS-REFERENCE TO RELATED U.S. PATENT APPLICATION

This present application claims priority under 35 U.S.C. §119(e) to U.S. Provisional Patent Application Ser. No. 61/786,798, entitled "MEDICAL PRODUCTS STORAGE DEVICE WITH VIEWING WINDOW HAVING VARIABLE OPACITY," which was filed on Mar. 15, 2013, the entirety of which is hereby incorporated by reference.

BACKGROUND

The present disclosure is related to climate controlled medical products storage devices, such as refrigerators and freezers. More specifically, the present disclosure is related to a medical products storage device with a variable opacity viewing window, the variable opacity viewing window operable to become translucent when a user with proper authorization for view through the window is detected.

Medical products storage devices may be used in laboratories, pharmacies, or clinics where multiple individuals work. In some cases, some individuals are authorized to access all of the medical products. Some individuals, however, may only be permitted to access a limited portion of the inventory that is used and stored in the laboratory, pharmacy, or clinic. In the case of certain products, it is important to maintain the temperature of the products within very close control. Opening the door of the storage device to check for the presence of products increases the variation in the temperature of the storage device. It is known to cover the windows of these storage devices to prevent unauthorized individuals from seeing what is stored in the storage devices.

In addition, medical products stored in a medical products storage device may be sensitive to light. Medications, chemicals, or blood products each may experience degradation if excessive light is applied to the medical products. In some devices, this issue is resolved by having a solid door on the storage device. The challenge of a solid door is that it is necessary to open the door for an individual to see what is inside of the medical storage device, which, as discussed above, may create unnecessary deviations and temperature inside the medical storage device.

SUMMARY

The present application discloses one or more of the features recited in the appended claims and/or the following features which, alone or in any combination, may comprise patentable subject matter:

According to the present disclosure, a medical products storage device comprises a refrigeration system, a cabinet defining a storage space, and a door. The door is coupled to the cabinet and movable between a first position allowing access to the storage space and a second position in which the storage space is enclosed. The door includes a window having glass that comprises a plurality of liquid crystal molecules, the glass being opaque when the liquid crystal molecules are deenergized and transparent when the liquid crystal molecules are energized by applying an electrical current.

In some embodiments, the door further comprises a plurality of light emitting diodes coupled to the glass, the light emitting diodes operable to vary between an energized state in which the light emitting diodes emit light and a deenergized state in which the light emitting diodes to not emit light.

In some embodiments, the light emitting diodes are selectively energized to indicate a status of the operation of the medical products storage device.

In some embodiments, the medical products storage device further comprises a controller, the controller operable to selectively energize the liquid crystal molecules in the glass.

In some embodiments, the controller is operable to selectively energize the light emitting diodes.

In some embodiments, the medical products storage device further comprises a user interface, the user interface operable to determine an authorization level of the user.

In some embodiments, the controller is operable to energize the liquid crystal molecules in the glass if the authorization level of a user qualifies the user to view the products in the storage space.

In some embodiments, the controller illuminates at least one of the plurality of light emitting diodes in response to an alarm condition detected by the controller.

In some embodiments, the controller illuminates a plurality of light emitting diodes in response to an alarm condition detected by the controller.

Additional features, which alone or in combination with any other feature(s), including those listed above and those listed in the claims, may comprise patentable subject matter and will become apparent to those skilled in the art upon consideration of the following detailed description of illustrative embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
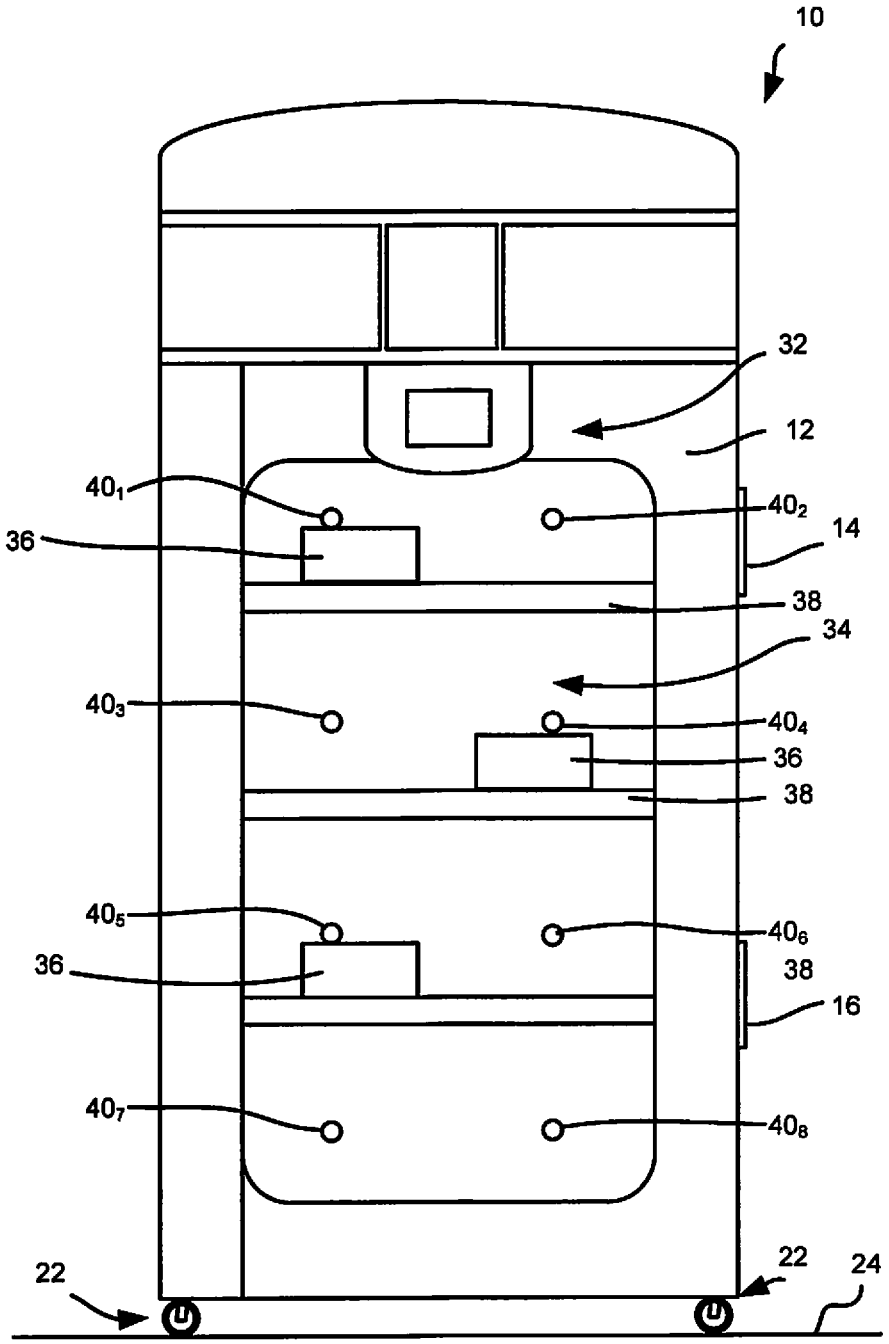
FIG. 1 is plan view of a climate controlled medical products storage device of the present disclosure, the medical products storage device including a viewing window with a variable opacity, the medical products storage device shown in FIG. 1 with the viewing in a translucent condition.
Figure 4:
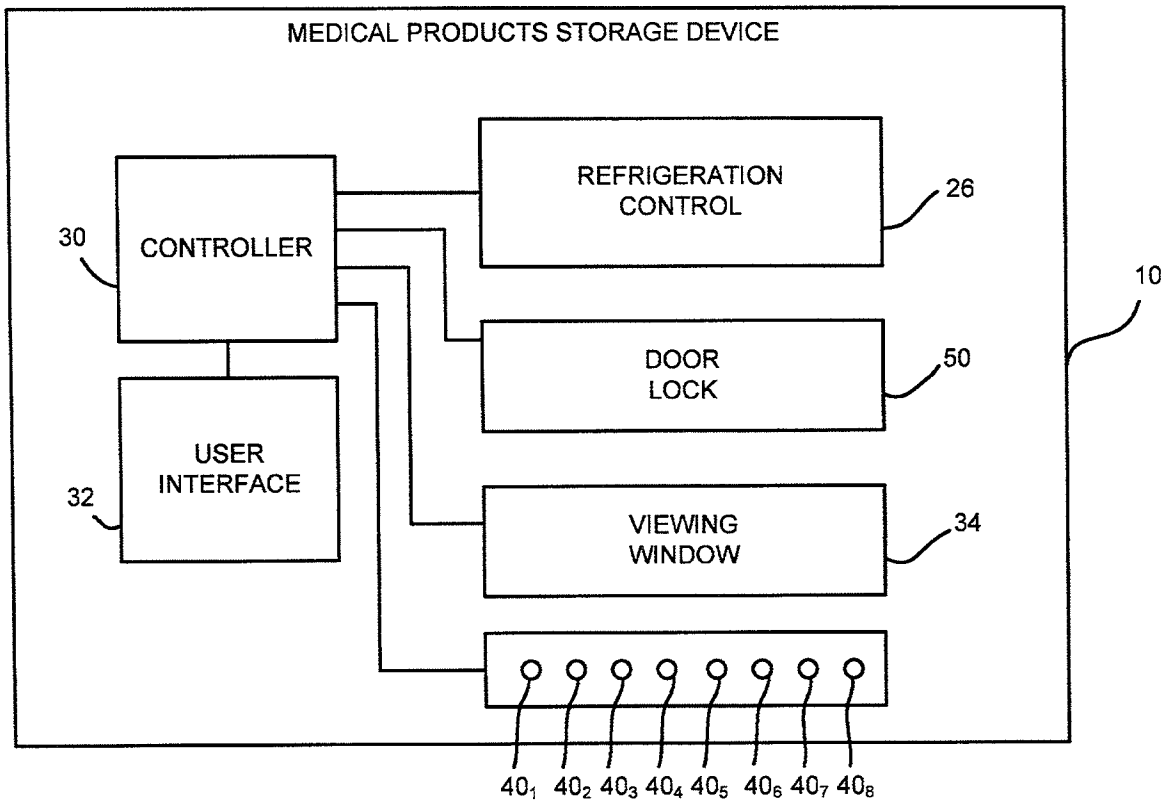
FIG. 4 is a block diagram of a control system of the medical products storage device.

A medical products storage device 10, illustratively embodied as a refrigerator, includes a door 12 pivotable about a pair of hinges 14 and 16 to provide access to a storage space 18 as shown in FIG. 1. The refrigerator 10 has a cabinet 20 supported on casters 22 which permit the refrigerator 10 to be moved over a floor 24. Operation of the refrigerator 10 is accomplished by a controller 30 shown in the block diagram of the refrigerator 10 at FIG. 4. The controller 30 is operable to control a refrigeration control system 26 as well as other components discussed below.

Referring again now to FIG. 1, a user interface 32 is positioned on the door 12 and may be used by a user to control the operation of the refrigerator 10 and access to the storage space 18. A viewing window 34 is positioned in the door 12. The window 34 comprises a number of liquid crystal molecules embedded within the glass of the window 34. When deenergized such that no electrical current is applied to the glass, the liquid crystal molecules are randomly oriented which blocks and scatters light making the window opaque. When energized by applying an electrical current, the liquid crystal molecules align allowing light to pass through. In some embodiments, the energization of the liquid crystal molecules is variable to vary the opacity of the glass of the window 34.

Figure 2:
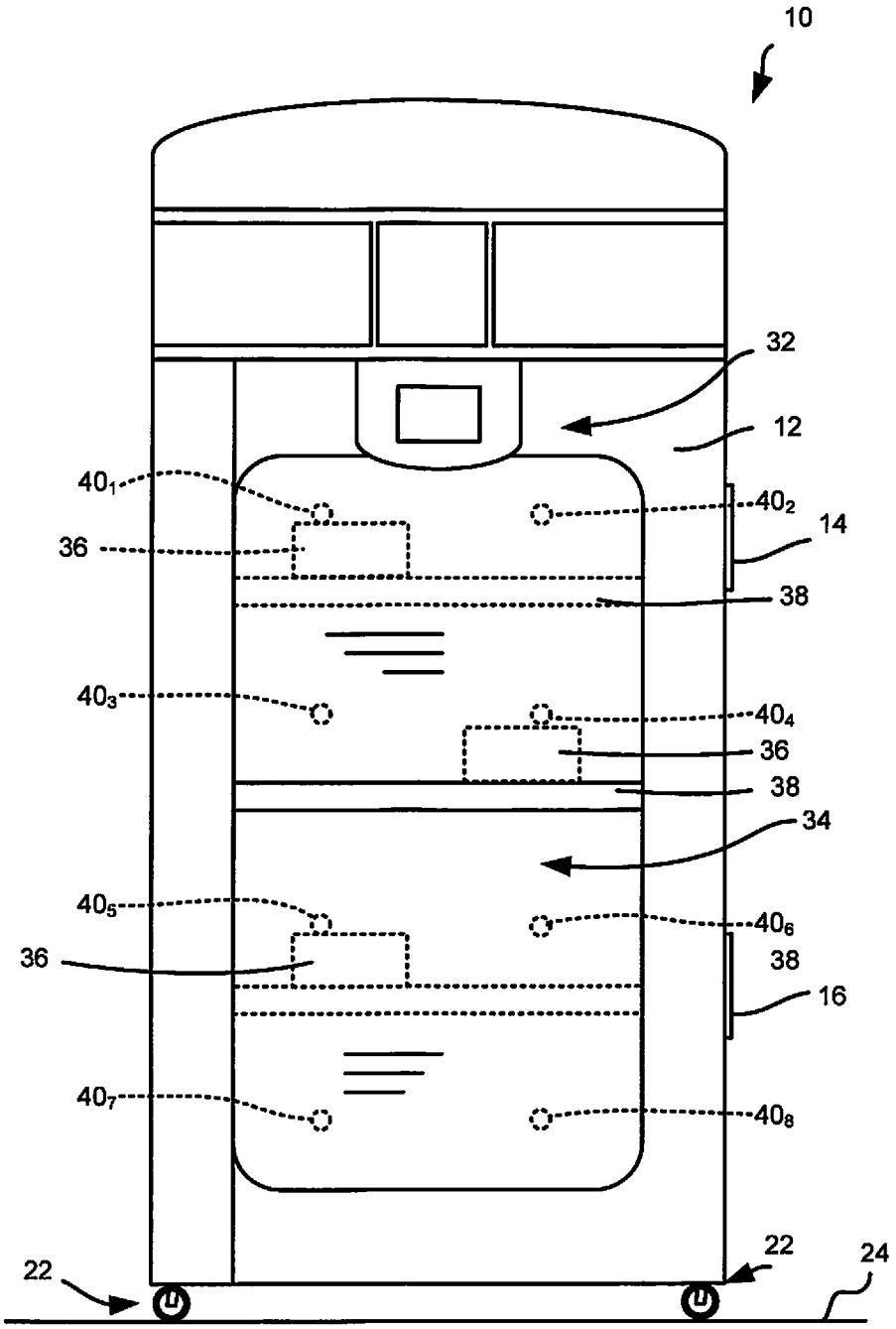
FIG. 2 is a plan view of the medical products storage device of FIG. 1 with the viewing window in an opaque condition.

The window 34, as shown in FIG. 1, is transparent due to the energization of the liquid crystal molecules. This allows a user to visualize the medical products 36 stored on shelves 38 in the storage space 18. In addition, a number of light emitting diodes $\mathbf{40}_1$-$\mathbf{40}_8$ are embedded in the glass of the window 34. When the window 34 is transparent, the structures of the light emitting diodes $\mathbf{40}_1$-$\mathbf{40}_8$ are visible, but are sized so as not to obscure the view into the storage space 18. As described in further detail below, the light emitting diodes $\mathbf{40}_1$-$\mathbf{40}_8$ are under the control of the controller 30 and may be selectively illuminated to indicate specific conditions of the refrigerator 10. It should be understood that the light emitting diodes $\mathbf{40}_1$-$\mathbf{40}_8$ are capable of being independently eliminated with one or more of the light emitting diodes $\mathbf{40}_1$-$\mathbf{40}_8$ being illuminated depending on outputs from the controller 30. When deenergized, as shown in FIG. 2, the glass of the window 34 becomes opaque such that the contents of the storage space 18 are not visible from outside of the refrigerator 10. In addition, the deenergized glass will block a majority of the ultraviolet and infrared light from passing through the window 34.

Figure 3:
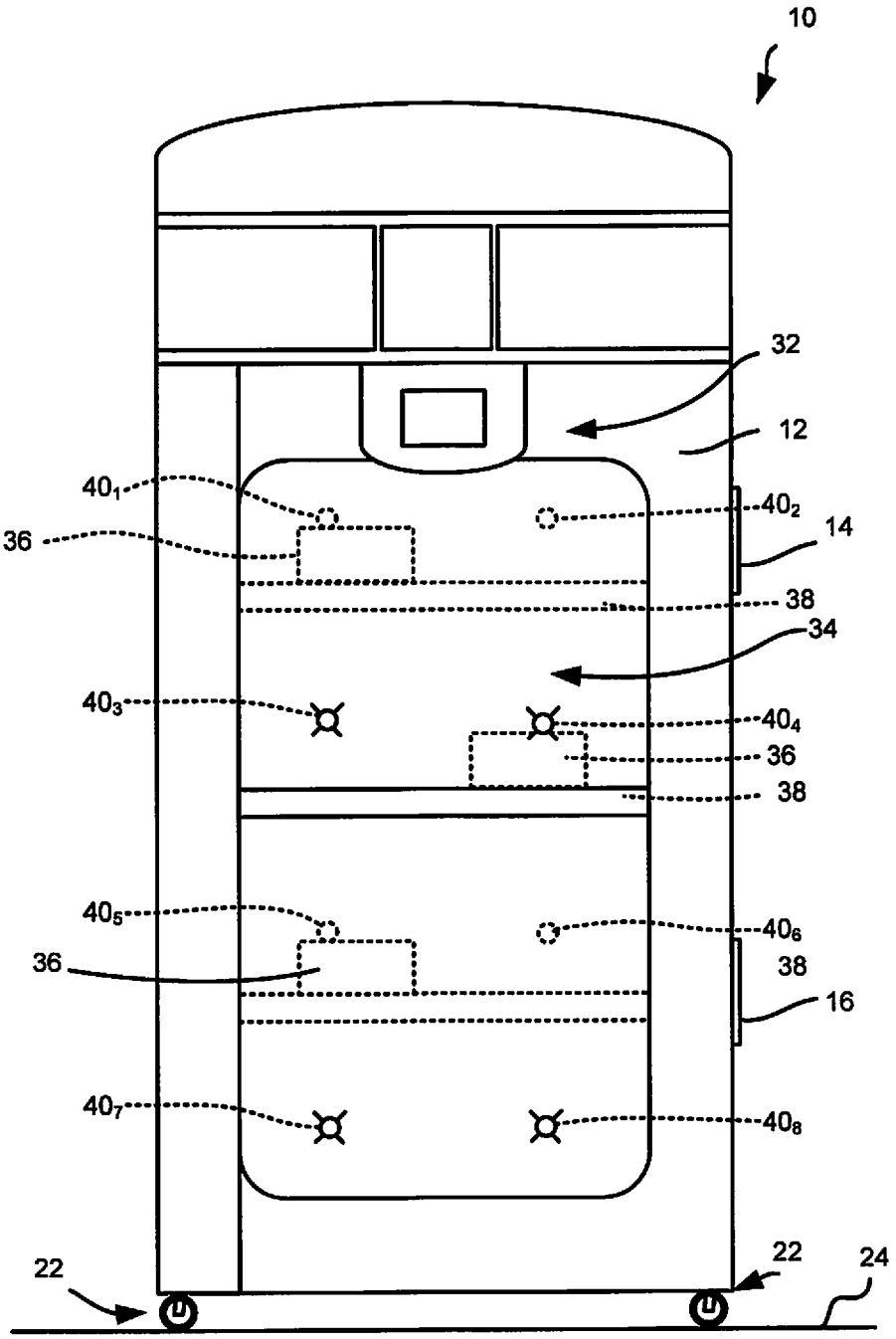
FIG. 3 is a plan view similar to the view of FIG. 2, the medical products storage device including light emitting diodes positioned in the viewing being illuminated to indicate an operational condition of the medical products storage device.

When illuminated, the light emitting diodes $\mathbf{40}_1$-$\mathbf{40}_8$ are visible even if the glass in the window 34 is deenergized. Thus, one or more of the light emitting diodes $\mathbf{40}_1$-$\mathbf{40}_8$ may be illuminated to emit a green color when the window is the energized to signify that the refrigerator 10 is operating normally. Other colors may be illuminated to indicate either a caution status or an alert status by illuminating yellow or red light emitting diodes respectively. For example, light emitting diodes $\mathbf{40}_1$, $\mathbf{40}_2$, $\mathbf{40}_5$, and $\mathbf{40}_6$ of the illustrative embodiment emit red light and are used to indicate an alert condition as suggested by FIG. 3.

In the illustrative embodiment, refrigerator 10 includes an automatic door lock 50 under the control of the controller 30. A user may access the refrigerator 10 by entering a code on the user interface 32 or by providing some other identifying signal to the refrigerator 10 such a swiping an RFID badge. Energization of the liquid crystal molecules in the glass of the window 34 to make the glass transparent may be accomplished using any of these methods as well. For example, a user may swipe an RFID card near the user interface 32, causing the glass in the window 34 to energized and become transparent. In some embodiments, the automatic lock may be activated by the RFID card swipe. In other embodiments, a second level of authorization may be required, such as entering an access code, for example.

The subsystems of the medical products storage device 10 may include structures known in the art. For example U.S. patent application Ser. No. 13/268,148 filed on Oct. 7, 2011 and entitled "CONTROLLER FOR A MEDICAL PRODUCTS STORAGE SYSTEM" is incorporated by reference in its entirety for the disclosure of system operation and alarm conditions in a medical products storage device. Furthermore, U.S. Pat. No. 7,638,100 entitled "PLATELET INCUBATOR" is also incorporated by reference in its entirety for the disclosure of control system operation and alarm conditions in a medical products storage device. Still further, U.S. Pat. No. 7,617,690 entitled "BLOOD PRODUCTS FREEZER WITH EVENT LOG" is also incorporated by reference in its entirety for the disclosure of control system operation and alarm conditions in a medical products storage device.

Although certain illustrative embodiments have been described in detail above, variations and modifications exist within the scope and spirit of this disclosure as described and as defined in the following claims.

The invention claimed is:

1. A medical products storage device comprising a refrigeration system, a cabinet defining a storage space, a door coupled to the cabinet, the door movable between a first position allowing access to the storage space and a second position, the door including a window having a glass comprising a plurality of liquid crystal molecules, substantially all of the glass being opaque when the liquid crystal molecules are deenergized and all of the glass being transparent when the liquid crystal molecules are energized, a controller, the controller operable to selectively energize the liquid crystal molecules in the glass, and a user interface, the user interface operable to determine an authorization level of the user by detecting a signal identifying the user, wherein the controller is operable to energize the liquid crystal molecules in the glass if the authorization level of a user qualifies the user to view the products in the storage space.

2. The medical products storage device of claim 1, wherein the door further comprises a plurality of light emitting diodes coupled to the glass, the light emitting diodes operable to vary between an energized state in which the light emitting diodes emit light and a deenergized state in which the light emitting diodes do not emit light.

3. The medical products storage device of claim 2, wherein the light emitting diodes are selectively energized to indicate a status of the operation of the medical products storage device.

4. The medical products storage device of claim 1, wherein the controller is operable to selectively energize the light emitting diodes.

5. The medical products storage device of claim 4, wherein the controller illuminates at least one of the plurality of light emitting diodes in response to an alarm condition detected by the controller.

6. The medical products storage device of claim 5, wherein the controller illuminates a plurality of light emitting diodes in response to an alarm condition detected by the controller.

7. The medical products storage device of claim 1, wherein the signal is derived from a code entered at the user interface.

8. The medical products storage device of claim 1, wherein the signal is derived from an RFID badge.

9. The medical products storage device of claim 4, wherein the signal is derived from a code entered at the user interface.

10. The medical products storage device of claim 4, wherein the signal is derived from an RFID badge.

11. A medical products storage device comprising a refrigeration system, a cabinet defining a storage space, a door coupled to the cabinet, the door movable between a first position allowing access to the storage space and a second position, the door including a window having a glass comprising a plurality of liquid crystal molecules, the door including an automatic door lock movable between a locked position and an unlocked position, a controller operable to transit substantially all of the glass between being transparent and opaque, and a user interface electrically coupled to the controller, the user interface operable to determine an authorization level of a user by detecting a signal identifying the user, wherein the controller is operable to energized the liquid crystal molecules in all of the glass if the authorization level of the user qualifies the user to view the products in the storage space, wherein the controller is further configured to require a second level of authorization to cause the controller to operate the electronic lock to unlock the door.

12. The medical products storage device of claim 11, wherein the controller denergizes the liquid crystal molecules to turn substantially all of the glass opaque and, the controller energizes the liquid crystal molecules to turn all of the glass transparent.

13. The medical products storage device of claim 11, wherein the door further comprises a plurality of light emitting diodes coupled to the glass, the light emitting diodes operable to vary between an energized state in which the light emitting diodes emit light and a deenergized state in which the light emitting diodes do not emit light.

14. The medical products storage device of claim 13, wherein the light emitting diodes are selectively energized to indicate a status of the operation of the medical products storage device.

15. The medical products storage device of claim 14, wherein the controller is further operable to selectively energize the light emitting diodes.

16. The medical products storage device of claim 15, wherein the controller illuminates at least one of the plurality of light emitting diodes in response to an alarm condition detected by the controller.

17. The medical products storage device of claim 11, wherein the controller illuminates a plurality of light emitting diodes in response to an alarm condition detected by the controller.

18. The medical products storage device of claim 11, wherein the signal is derived from a code entered at the user interface.

19. The medical products storage device of claim 11, wherein the signal is derived from an RFID badge.

* * * * *